US005718292A

United States Patent [19]

Heathman et al.

[11] Patent Number: 5,718,292

[45] Date of Patent: Feb. 17, 1998

[54] INFLATION PACKER METHOD AND APPARATUS

[75] Inventors: James F. Heathman; David F. Laurel, both of Duncan, Okla.

[73] Assignee: Halliburton Company, Duncan, Okla.

[21] Appl. No.: 680,078

[22] Filed: Jul. 15, 1996

[51] Int. Cl.[6] ..... E21B 33/127

[52] U.S. Cl. ..... 166/387; 166/187

[58] Field of Search ..... 166/187, 387, 166/106, 117.6, 120; 277/34.6

[56] References Cited

U.S. PATENT DOCUMENTS

| | | | |
|---|---|---|---|
| 3,762,470 | 10/1973 | Eggleston | 166/182 |
| 4,455,027 | 6/1984 | Baski | 277/34.6 |
| 4,458,752 | 7/1984 | Brandell | 166/187 |
| 4,474,380 | 10/1984 | Carter, Jr. | 277/34.6 |
| 4,768,590 | 9/1988 | Sanford et al. | 166/187 |
| 4,968,184 | 11/1990 | Reid | 405/225 |
| 5,488,994 | 2/1996 | Laurel et al. | 166/387 |

*Primary Examiner*—Frank Tsay
*Attorney, Agent, or Firm*—Craig W. Roddy

[57] ABSTRACT

An inflation packer method and apparatus comprising at inflatable packer bladder and an inflation fluid. The packer apparatus further comprises a packer mandrel having a central flow passage therethrough and an outer packer body which includes the inflatable packer bladder. A chemical expanding additive is employed to expand the inflation fluid used to inflate the packer bladder. An annular inflation fluid passageway is defined between the mandrel and the body. Inflation fluid passes from the central flow passage into the annular inflation fluid passageway to inflate the inflatable packer bladder. The mandrel has grooves defined on an outer surface thereof. The chemical expanding additive is placed in grooves defined on the outer surface of the mandrel so that the expanding additive is dispersed into the fluid passing into the annular passageway.

20 Claims, 3 Drawing Sheets

INFLATION PACKER METHOD AND APPARATUS

BACKGROUND

The present invention generally relates to an inflation packer method and apparatus. More specifically, but not by way of limitation, this invention relates to an improved inflation packer which uses an inflation fluid and an expanding additive to expand the inflation fluid within a packer bladder.

Typically, inflation packer assemblies utilize either mud or cement to inflate the packer bladder so that the bladder seals against a well bore. Mud inflation systems typically utilize a valve system to maintain pressure in the bladder, while cement systems generally rely on the compressive strength of the gelled or hardened cement. Both systems have inherent problems.

Because a packer inflated with mud is dependent solely on the valve system, the packer is susceptible to leakage which will cause the bladder to deflate. Cement used to inflate the bladder takes several hours to develop sufficient compressive strength to support a weight above it. In addition, when cement is used as the inflation fluid, bulk shrinkage of the cement in the packer bladder can occur and cause the seal to break between the packer and the well bore. Because of such inherent problems, packers using either cement or mud are susceptible to hydrostatic differential pressure in the well bore which can cause the packer bladder to move, thereby breaking the seal between the packer and the well bore.

SUMMARY

The present invention provides an improved inflation packer method and apparatus which eliminates the problems experienced when utilizing prior art inflation systems. The invention comprises an inflation packer apparatus which uses an inflation fluid to inflate a packer bladder and an expanding additive to expand the fluid therein. A valve system is used for inflating the bladder and displacing the fluid.

The inflation packer apparatus of the present invention has a packer body which includes a packer element. The packer element includes an inflatable packer bladder. A packer mandrel with a central flow passage defined therethrough is disposed in the packer body. The packer mandrel generally may be comprised of an upper packer mandrel with a central bore and a lower packer mandrel which also has a central bore. The central bores of the upper and lower mandrels generally makeup the central flow passage. The packer apparatus also includes an inflation passage means for communicating inflation fluid from the central flow passage in said packer mandrel to the inflatable packer bladder.

The inflation passage means generally includes a longitudinally extending annular inflation fluid passageway defined between the packer mandrel and the packer body, and an inflation port defined in the packer mandrel which communicates the central flow passage with the annular inflation fluid passageway.

The packer apparatus also includes a communication or circulation means for communicating the central flow passage with a well bore. The circulation means is operably associated with the packer bladder, so that the circulation means will not communicate the central flow passage with the well bore until the packer bladder reaches a desired inflation pressure. The circulation means generally includes the inflation port and a circulation port defined through the packer body. The circulation port will initially be closed with a rupture disk or other closure means installed therein, so that fluid passing through the inflation port passes into the annular passageway and into the inflatable packer bladder. The circulation port will open after the packer bladder reaches its maximum or desired inflation pressure thereby communicating the central flow passage with the well bore.

The invention includes an expanding additive which is operably associated with the inflation passage means, wherein the expanding additive reacts with the inflation fluid to expand the fluid. Typically, the expanding additive will be placed in the annular inflation fluid passageway prior to the time the packer apparatus is lowered into the well bore, so that as the inflation fluid used to inflate the packer bladder passes through the annular inflation fluid passageway, the expanding additive is dispersed throughout the fluid.

The annular inflation fluid passageway may have a check valve disposed therein which divides the passageway into an upper portion and a lower portion. The inflation port communicates the central flow passage with the upper portion of the annular inflation fluid passageway. The check valve allows the inflation fluid to pass from the upper portion of the passageway to the lower portion of the passageway, but prevents the fluid from flowing in the opposite direction. The inflatable packer bladder is disposed about the lower packer mandrel adjacent the lower portion of the annular inflation fluid passageway. Thus, the check valve provides a means for inflating the inflatable packer bladder and for holding fluid pressure in the lower portion of the annular inflation fluid passageway thereby maintaining pressure in the packer bladder.

The expanding additive is placed in the lower portion of the annular inflation fluid passageway. The portion of the packer mandrel adjacent to the lower inflation fluid passageway, which ordinarily comprises the lower packer mandrel, has spiral grooves defined on an outer surface thereof. The expanding additive is placed in the spiral grooves defined on the outer surface of the packer mandrel, so that the expanding additive will be evenly dispersed in the inflation fluid.

The method of the present invention generally comprises attaching to a tubing string an inflation packer apparatus comprising an inflatable packer bladder and lowering the packer apparatus into a well bore. The method further comprises circulating a fluid through the packer apparatus as it is lowered into the well, pumping an inflation fluid into the packer apparatus after it reaches a desired depth, inflating the inflatable packer bladder with the inflation fluid and expanding the fluid within the bladder.

The expanding step generally includes placing a chemical expanding additive in the packer apparatus prior to lowering it into the well bore, and dispersing the additive into the fluid used to inflate the bladder. The additive is generally placed in an inflation fluid passageway between a packer mandrel and a packer body. The method may then be carried out by blocking or obstructing flow in the central flow passage, directing flow into the annular passageway, and dispersing the additive into the inflation fluid directed into the passageway. The method may further comprise communicating the well bore with the central flow passage above the packer bladder after the bladder is inflated, so that the inflation fluid, or other fluid passing through the central flow passage can be communicated into the well bore. Thus, an object of the present invention is to provide an improved inflation packer for use in a well bore when cementation is to take place off the bottom of the well bore, such as, but not by way of limitation, setting sidetrack plugs, or setting a plug in a well that is to be abandoned. Another object is to provide a method for rapidly hydrating and expanding the fluid used to inflate the packer bladder.

BRIEF DESCRIPTION OF THE DRAWINGS

These and other features, aspects, and advantages of the present invention will become better understood with regard to the following description, appended claims, and accompanying drawings where:

DESCRIPTION

Figure 1A:
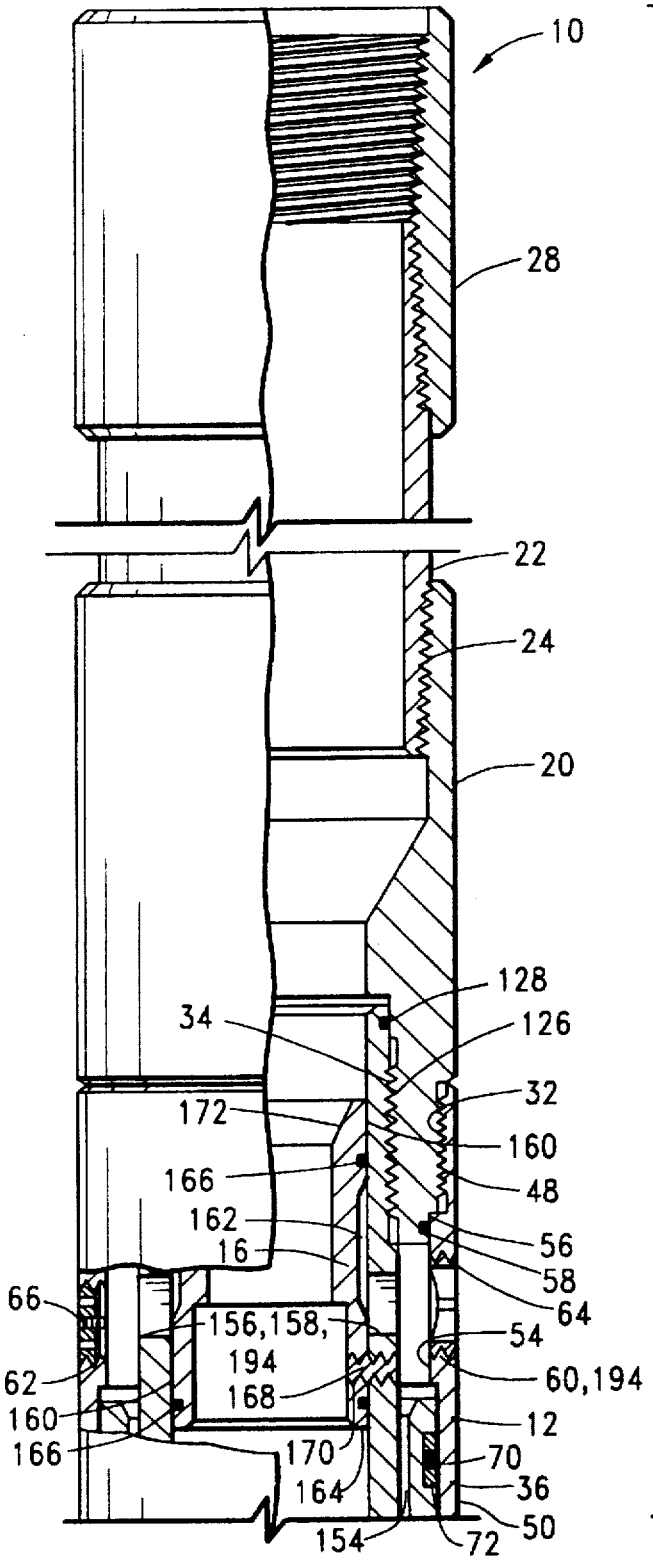
FIGS. 1A–1D show an elevation partial section view of the packer apparatus of the present invention.
Figure 1B:
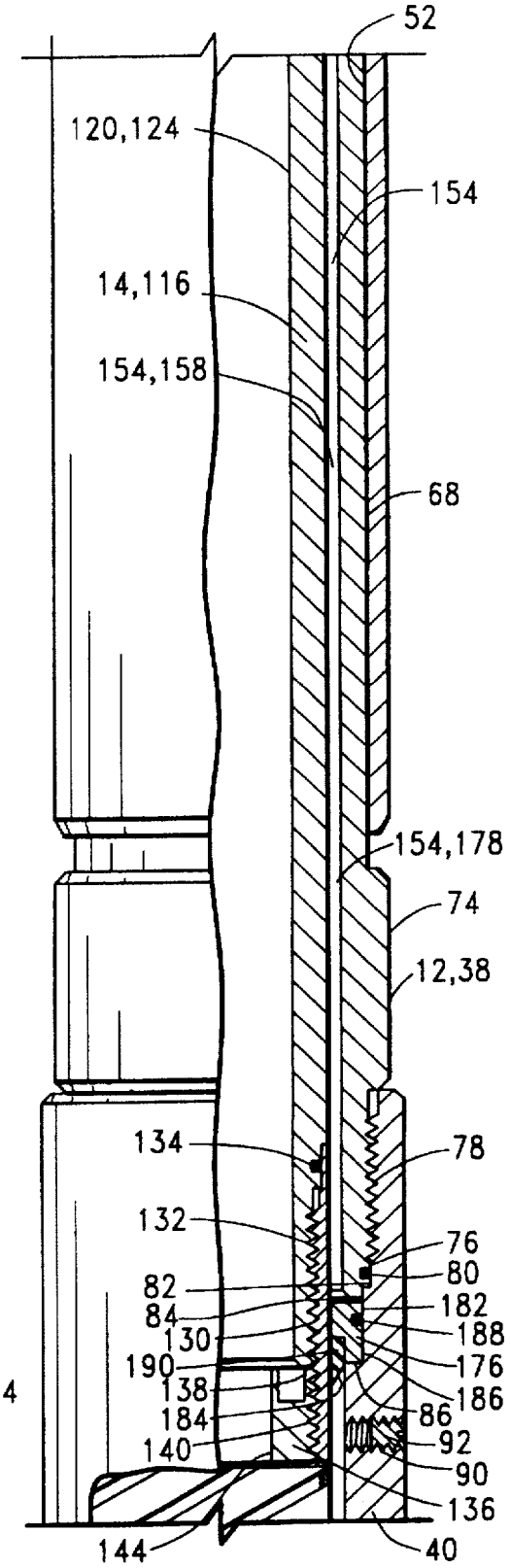
Figure 1C:
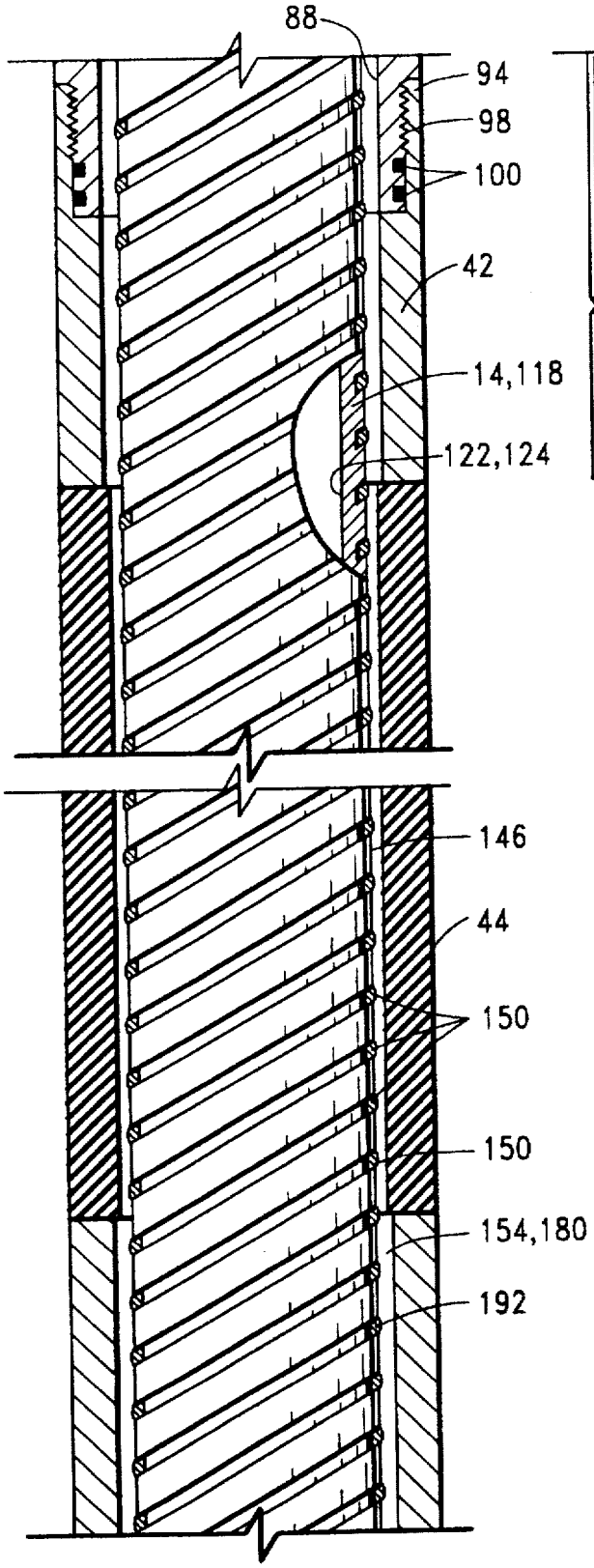
Figure 1D:
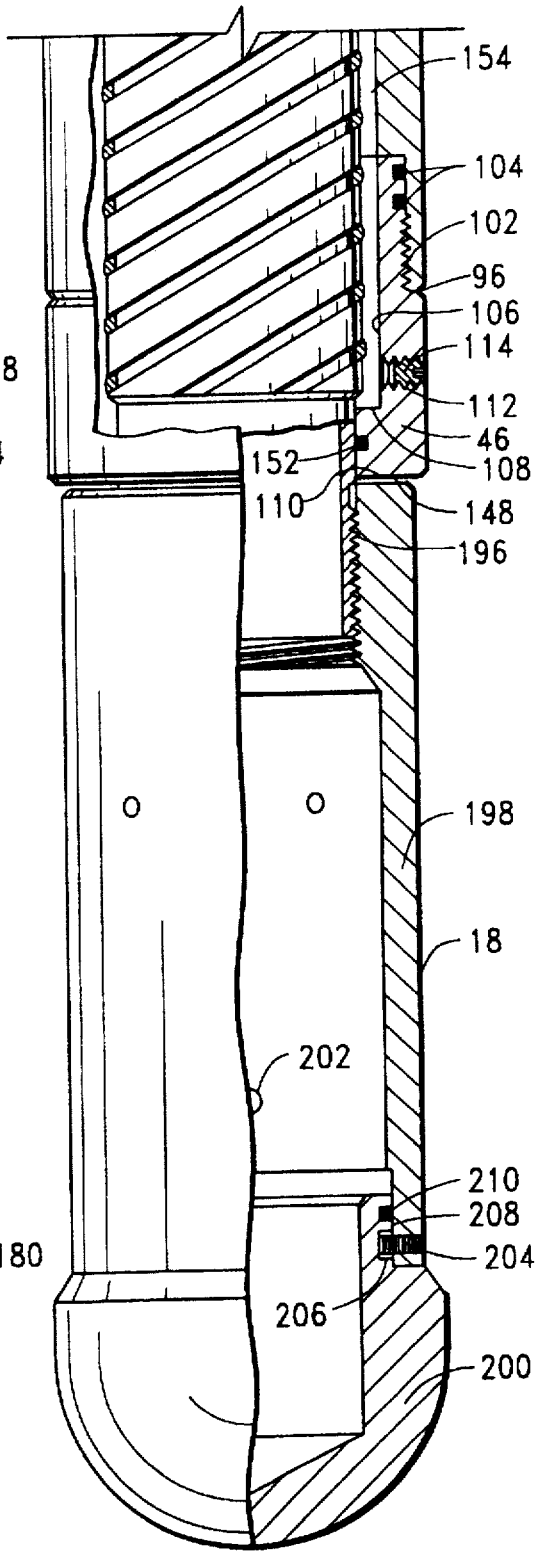
Figure 2:
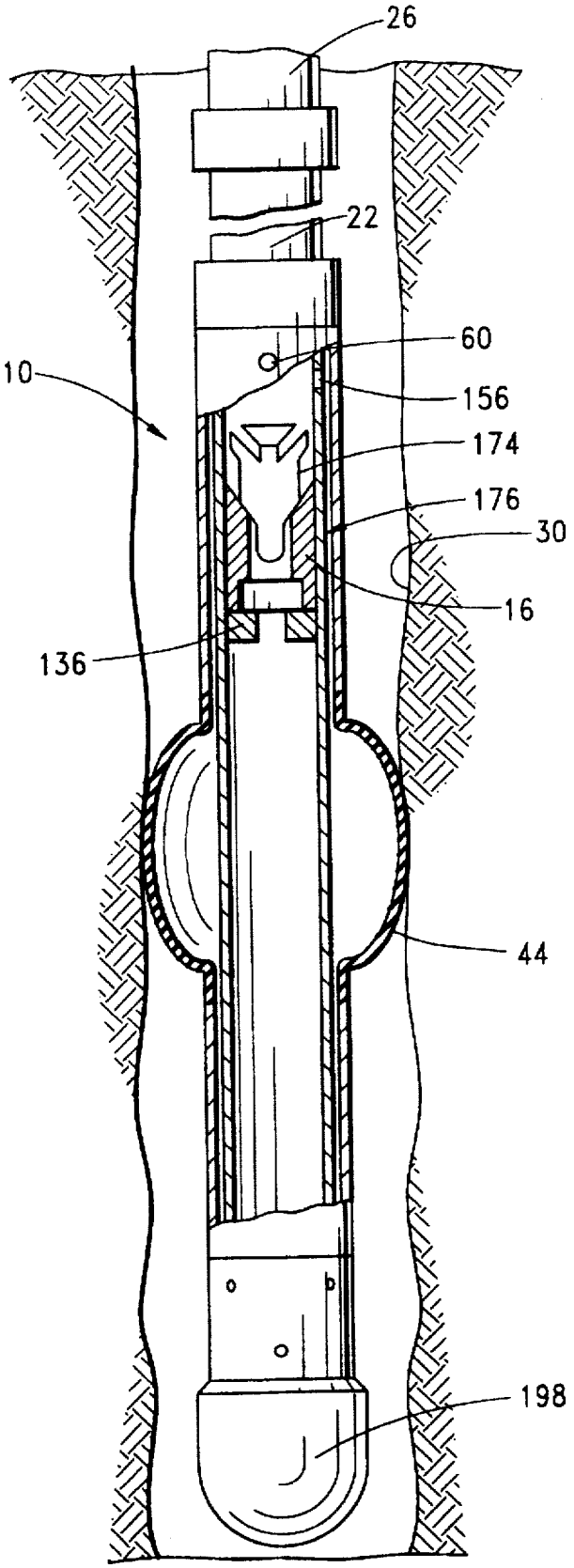
FIG. 2 shows a schematic view of the present invention in a well bore with the packer inflated.

Referring now to the drawings, FIGS. 1A–1D illustrate an inflatable packer apparatus of the present invention, which is generally designated by the numeral 10. The inflatable packer apparatus 10 generally includes a substantially cylindrical packer body 12, a substantially cylindrical packer mandrel 14, an inflation port opening sleeve 16, a fluid diverter assembly 18 and a lift sub or upper adapter 20. The lift sub 20 may be connected at its upper end to a tail pipe 22 at a threaded connection 24. The tail pipe 22 is adapted to be connected to a tubing string 26 thereabove with a threaded coupling 28. Alternatively, the lift sub 20 may be connected directly to the tubing string 26. The apparatus 10 is shown in FIG. 2 attached to the tubing string 26 extending into a well bore 30.

The lift sub 20 has an outer thread 32 and an inner thread 34 defined at its lower end. The packer body 12 includes an upper body extender 36, a lower packer body extender 38, an upper end ring 40, a packer element 42 which includes an inflatable packer bladder 44, and a lower end ring 46. FIG. 2 shows a schematic of the apparatus 10 with the packer bladder 44 inflated to seal against the side of the well bore 30. The upper packer body extender 36 is connected at a threaded connection 48 to the lift sub 20 at the outer threads 32. The upper body extender 36 includes an outer surface 50 and an inner surface 52, which includes an inwardly extending lug 54. The inwardly extending lug 54 engages an outer surface 56 of lift sub 20 with a seal provided therebetween by an O-ring seal 58. The inwardly extending lug 54 has a circulation port 60 and a valve port 62 defined therethrough. The upper body extender 36 may include a plurality of circulation ports 60. A rupture disc 64 is threadedly received in the circulation port 60 and a pressure regulating valve 66 is threadedly received in the valve port 62.

The lower body extender 38 includes a first outer surface 68 which is closely received in the upper body extender 36. A seal is provided between the upper and lower body extenders 36, 38 with an O-ring seal 70. The seal 70 is disposed in a groove 72 defined on the outer surface 68 of the lower body extender 38. The lower body extender 38 further includes a second outer surface 74 and a third outer surface 76. The lower body extender 38 is connected to the upper end ring 40 at a threaded connection 78 with a seal provided therebetween by an O-ring seal 80. The O-ring seal 80 provides a seal between the third outer surface 76 of the lower body extender 38 and a first inner surface 82 of the upper end ring 40. The upper end ring 40 further includes a second inner surface 84, an upwardly facing shoulder 86 and third inner surface 88. An upper additive fill port 90 is defined radially through the end ring 40, and has a threaded plug 92 received therein.

The packer element 42 has an upper end 94 and a lower end 96. The packer element 42 is connected at its upper end 94 to the upper end ring 40 at a threaded connection 98 with a seal provided therebetween by O-ring seals 100. The packer element 42 is connected at its lower end 96 to the lower end ring 46 at a threaded connection 102 with a seal provided therebetween by O-ring seals 104. The lower end ring 46 includes a first inner surface 106, upward facing shoulder 108 and a second inner surface 110. A lower additive fill port 112 is defined through the lower end ring 46, and has a threaded plug 114 received therein.

The packer mandrel 14 includes an upper mandrel 116 and a lower mandrel 118. The upper mandrel 116 and lower mandrel 118 each include a respective central bore 120 and 122. The central bores 120 and 122 may be referred to collectively as a central flow passage 124. The upper mandrel 116 is connected to the inner threads 34 of the lift sub 20 at a threaded connection 126, with a seal provided therebetween by an O-ring seal 128. The upper mandrel 116 is connected to an upper inner thread 130 of the lower mandrel 118 at a threaded connection 132. A seal is provided between the upper mandrel 116 and the lower mandrel 118 by an O-ring seal 134. A stop collar 136 is connected to the threads 130 below a lower end 138 of the upper packer mandrel 116 at a threaded connection 140. The stop collar 136 includes an upper surface 142 and a central bore 144. The central bore 144 of the stop collar 136 has a diameter smaller than the central bore 120 of the upper mandrel 116. The upper surface 142 therefore extends radially inward into the central flow passage 124.

The lower mandrel 118 includes a first outer surface 146 and a second outer surface 148. The first outer surface 146 of the lower mandrel 118 has a plurality of spiral grooves 150 defined thereon. The mandrel 118 preferably includes from 3 to 9 grooves, and more preferably includes 6 grooves. The second outer surface 148 of the lower mandrel 118 is closely received in the second inner surface 110 of the lower end ring 146. A seal is provided between the lower mandrel 116 and the end ring 46 by a resilient O-ring seal 152.

A longitudinally extending annular inflation fluid passageway 154 is defined between the packer mandrel 14 and the packer body 12. The passageway 154 terminates at the upward facing shoulder 108 of the lower end ring 46. The upper mandrel 116 has an inflation port 156, and may include a plurality of inflation ports 156, radially defined therethrough which communicates the central flow passage 124 with the annular inflation fluid passageway 154. The pressure regulating valve 66 allows fluid to flow only in a direction into the annular inflation passageway 154 from the well bore 30, thus equalizing the pressure in the well bore 30 and the passageway 154 and preventing the inflatable packer bladder 44 from collapsing as the apparatus 10 is lowered into the well bore 30. The inflation port 156 and annular inflation fluid passageway 154 may be referred to as an inflation passage means 158 for communicating inflation fluid to the packer bladder 44.

Flow through the inflation port 156 is initially blocked by the inflation port opening sleeve 16, which is closely received in the central bore 120 of the upper mandrel 116. The inflation port opening sleeve 16 includes an outer surface 160, a recessed surface 162 and a lower end 164. A seal is provided between the upper bore 120 and the outer surface 160 by a plurality of O-rings 166. The opening sleeve 16 is releaseably attached in the upper bore 120 with shear pins 168 that extend radially into the upper mandrel 116 and into a plurality of apertures 170 defined in the opening sleeve 16.

The opening sleeve 16 further includes a plug or ball seat 172 defined on its upper surface for receiving an opening dart or opening ball 174. The opening dart 174 drops through the tubing string 26 and into the central flow passage 124 until it is received in the plug seat 172, blocking flow through the central passage 124. The opening dart 174 is shown schematically in FIG. 2, and may be of any type known in the art. Pressure is increased in the tubing string 26 thereby causing the shear pins 168 to break off, releasing the opening sleeve 16 from the upper mandrel 116. The opening sleeve 16 falls through the central flow passage 124 until the lower end 164 thereof engages the upper surface 142 of the top collar 136, thereby blocking flow through the central flow passage 124 and directing flow through the inflation port 156 into the annular inflation fluid passageway 154.

A check valve assembly 176 is disposed in the annular inflation fluid passageway 154 dividing the passageway 154 into an upper portion 178 and a lower portion 180. The check valve assembly 176 includes a backup ring 182 with a seal 184 attached thereto. The backup ring 182 has an outer surface 186 which is closely received in the second inner surface 84 of the upper end ring 40, with a seal provided therebetween by an O-ring seal 188. The backup ring 182 further includes a lower surface 190 which abuts the upward facing shoulder 86 of the end ring 40. The check valve 176 allows fluid to flow only in a direction from the upper portion 178 to the lower portion 180 of the annular inflation fluid passageway 154. The packer bladder 44 is adjacent to the lower portion 180 of the annular passageway 154. Inflation fluid therefore passes from the central flow passage 124 through the inflation port 156 and into the upper portion 178 of the annular inflation fluid passageway 154. Inflation fluid then passes into the lower portion 180 of the passageway 154, thereby inflating the packer bladder 44, as shown in FIG. 2, so that the bladder 44 seals against the well bore 30.

A chemical expanding additive 192 is operably associated with the inflation passage means 158 so that the expanding additive 192 is dispersed into the inflation fluid used to inflate the packer bladder 44. The expanding additive 192 expands the inflation fluid. The chemical expanding additive 192 is placed in annular inflation fluid passageway 154 so that it is dispersed into the inflation fluid as it passes into the passageway 136. Preferably, the inflation fluid comprises a known fluid such as cement, slag, slag cement, treated water, mud or other known reactive fluids which are suitable for carrying components capable of providing volumetric expansion. Preferred inflation fluids include those commercially available under the tradenames INJECTROL®, KMAX, and PERMSEAL from Halliburton Energy Services of Duncan, Okla.

The preferred expanding additive 192 is selected from the group consisting of, but is not limited to, an aluminum powder for providing gaseous expansion which is commercially available under the tradenames "GAS CHECK®" and "SUPER CBL" from Halliburton Energy Services of Duncan, Okla.; a blend containing gypsum for providing crystalline growth which is commercially available under the tradename "MicroBond" from Halliburton Energy Services of Duncan, Okla.; and deadburned magnesium oxide for providing crystalline growth which is commercially available under the tradenames "MicroBond M" and "MicroBond HT" from Halliburton Energy Services of Duncan, Okla. Such preferred expanding additives 192 are described in U.S. Pat. Nos. 4,304,298; 4,340,427; 4,367,093; 4,450,010 and 4,565,578, which are assigned to the assignee of the present application and are incorporated herein by reference. Other expanding additives 192 known in the art may also be used for expanding the packer bladder 44, e.g., nitrogen blowing agents; crystalline growth agents such as calcium sulfate or sodium sulfate; and/or any other gaseous generating or crystalline growth materials known in the art.

Generally the expanding additive 192 is placed in lower portion 180 of the annular passageway 154 and more specifically in the grooves 150, which are defined on the lower mandrel 118 adjacent to the lower portion 180 of the passageway 154. The grooves 150 provide a means for evenly dispersing the additive 192 into the inflation fluid as it passes into lower portion 180 of the annular passageway 154. The expanding additive 192 may be placed in the passageway 154 through the upper and lower additive fill ports 90, 112, respectively.

Thus, once the inflation port opening sleeve 16 is released, inflation fluid flows through the inflation port 156 into the upper portion 178 of the annular inflation fluid passageway 154 and into the lower portion 180, where the chemical expanding additive 192 is dispersed into the inflation fluid. The inflation fluid is pumped into the central flow passage 124 and directed into the annular inflation fluid passageway 154 until the packer bladder 44 reaches a maximum or desired inflation pressure.

The rupture disk 64 is operably associated with the packer bladder 44, so that it ruptures when the bladder 44 reaches its maximum inflation pressure, thereby communicating the well bore 30 with the central flow passage 124 through the inflation port 156 and the circulation port 60. The inflation port 156 and the circulation port 60 may thus be referred to as a communication or circulation means 194 for communicating fluid to the well bore 30 from the central flow passage 124. The circulation means 194 is operably associated with the packer bladder 44 so that, as described hereinabove, fluid is communicated to the well bore 30 only after the packer bladder 44 reaches its desired inflation pressure.

The lower mandrel 118 is connected to the fluid diverter assembly 18 at a threaded connection 196. The fluid diverter assembly 18 includes a fluid diverter sub 198 and a guide nose 200. The fluid diverter sub 198 has a plurality of jetting apertures 202 defined therethrough. The jetting apertures 202 will jet fluid circulated through the apparatus 10 upward and tangentially as the apparatus 10 is lowered into the well bore 30. The jetting action will assist and provide a means for breaking gelled mud and other debris from the well bore 30. The guide nose 200 is attached to the fluid diverter sub 198 with a shear pin 204 that extends through the fluid diverter sub 198 and into a groove 206 defined in a first outer surface 208 of the guide nose 200. The first outer surface 208 is closely received in the fluid diverter sub 198. A seal is provided between the fluid diverter sub 198 and the guide nose 200 by an elastomeric O-ring seal 210.

METHOD OF OPERATION

The method of the present invention generally includes providing the tubing string 26 with the packer apparatus 10 of the present invention attached thereto and lowering the tubing string 26 into the well bore 30. Fluid may be circulated through the tubing string 26 and the packer apparatus 10 as it is lowered into the well bore 30. The guide nose 200 assists the apparatus 10 as it is being lowered into the well bore 30. The jetting apertures 202 in the fluid diverter sub 198 jet fluid circulated through the apparatus 10 upwardly and tangentially as the apparatus 10 is lowered into the well bore 30. The jetting action of the fluid will assist in breaking gelled mud and other debris from the side of the well bore 30 as the apparatus 10 is being lowered therein.

The pressure regulating valve 66 equalizes the pressure in the annular inflation passageway 154 with the pressure in well bore 30 thereby preventing the inflatable packer bladder 44 from collapsing while the apparatus 10 is lowered into the well bore 30. Once the packer apparatus 10 reaches the desired depth, the method comprises pumping an inflation fluid through the tubing string 26 and into the apparatus 10, inflating the inflatable packer bladder 44 with the fluid and expanding the inflation fluid therein. The chemical expanding additive 192 is placed in the packer apparatus 10 prior to lowering the apparatus 10 in the well bore 30, so that it will be dispersed in the inflation fluid used to inflate packer bladder 44. The inflation fluid is communicated to the inflatable packer bladder 44 by dropping the ball plug 174 into the tubing string 26 so that it engages with the ball seat 172 of the inflation port opening sleeve 16. Pressure is increased in the tubing string 26 causing the shear pins 168 to break thereby releasing the opening sleeve 162. The lower end of the opening sleeve 16 is retained in the central flow passage 124 by the upper surface 142 of the stop collar 136. Thus, flow through the central flow passage 124 is blocked. Fluid pumped into the central flow passage 124 is therefore directed through the inflation port 156 and into the longitudinally extending annular inflation passageway 154.

The inflation fluid passes from the upper portion 178 of the annular inflation fluid passageway 154 to the lower portion 180 thereof. The portion of the packer mandrel 14 adjacent to the lower portion 180 of the passageway 154 includes the plurality of grooves 150. The chemical expanding additive 192 is placed in the grooves 150 prior to lowering the apparatus 10 into the well bore 30, and is dispersed into the inflation fluid that passes into the lower portion 180 of the annular inflation fluid passageway 154. The inflation fluid is continually pumped to the central passageway 124 and into the annular inflation fluid passageway 154 until the inflatable packer bladder 44 reaches its desired or maximum inflation pressure thereby sealing against the well bore 30. The fluid is prevented from flowing out of the lower portion 180 of the passageway 154 by the check valve 176. The chemical expanding additive 192 dispersed in the inflation fluid expands the inflation fluid within the packer bladder 44. The chemical expanding additive 192 is placed in the grooves 150 through the additive fill ports 90, 112.

After the inflatable packer bladder 44 reaches its maximum or desired inflation pressure, the rupture disk 64 ruptures communicating central flow passageway 124 with the well bore 30 through the inflation port 156 and the circulation port 60. The inflation fluid can be continually displaced in the well bore 30 for the purpose of, but not limited to, filling the well bore 30 to abandon a hole, or for setting a sidetrack or kickoff plug.

Thus, it is seen that the apparatus 10 and methods of the present invention readily achieve the ends and advantages mentioned as well as those inherent therein. While certain preferred embodiments of the invention have been illustrated and described for purposes of the present disclosure, numerous changes may be made by those skilled in the art, which changes are encompassed within the scope and spirit of the present invention as defined by the appended claims.

What is claimed is:

1. An inflation packer apparatus, comprising:

an inflatable packer bladder;

an inflation fluid;

wherein the packer apparatus includes means for communicating said inflation fluid to the packer bladder; and a chemical expanding additive dispersed in said inflation fluid, wherein said expanding additive expands said inflation fluid within said packer bladder.

2. The apparatus of claim 1, wherein said expanding additive is operably associated with said means for communicating.

3. The apparatus of claim 1, wherein said inflation fluid comprises a cementitious fluid.

4. The apparatus of claim 1, wherein said expanding additive is selected from the group consisting of aluminum powder, deadburned magnesium oxide, and a blend containing gypsum.

5. The apparatus of claim 1, further comprising:

a packer body;

a packer mandrel disposed in said packer body and having a flow passage defined therethrough, wherein said means for communicating includes:

said packer mandrel and said packer body having an inflation fluid passageway defined between;

said packer mandrel having an inflation port defined therein;

wherein the inflation port communicates the flow passage with the inflation fluid passageway; and wherein said inflation fluid is communicated from said flow passage to said inflation fluid passageway thereby inflating said inflatable packer bladder.

6. The apparatus of claim 5, wherein said expanding additive is placed in the inflation fluid passageway and is dispersed in said inflation fluid as said fluid flows into the passageway.

7. The apparatus of claim 5, further comprising:

an inflation port opening sleeve disposed in the flow passage, said opening sleeve being releasably retained in said packer mandrel and being initially located to obstruct flow through the inflation port; and a ball seat defined on said opening sleeve for receiving an inflation port opening ball, so that after the ball is received in said ball seat said opening sleeve will be released thereby opening the inflation port.

8. The apparatus of claim 5, further comprising:

a check valve disposed in the inflation fluid passageway thereby dividing the passageway into an upper portion and a lower portion, said check valve allows fluid to flow from the upper portion to the lower portion but prevents flow in the opposite direction; and wherein said expanding additive is placed in the lower portion of the inflation fluid passageway.

9. The apparatus of claim 5, further comprising:

means for evenly dispersing said expanding additive throughout said inflation fluid.

10. The apparatus of claim 9, wherein said means for dispersing comprises:

a plurality of spiral grooves defined on an outer surface of said packer mandrel adjacent the inflation fluid passageway, wherein said chemical expanding additive is deposited in said spiral grooves.

11. The apparatus of claim 5, further comprising:

circulation means for communicating the flow passage with a well bore, said circulation means being operably associated with said packer bladder so that the flow passage is communicated with the well bore after said packer bladder is inflated to a maximum inflation pressure.

12. The apparatus of claim 11, wherein said circulation means comprises:

said packer body having a circulation port defined therein and communicated with the inflation port, the circulation port initially being closed; and wherein the circulation port opens after said packer bladder reaches a maximum inflation pressure thereby communicating the flow passage with the well bore.

13. The apparatus of claim 5, further comprising:

a fluid diverter sub attached to a lower end of said packer mandrel; and a guide nose, releaseably attached to said fluid diverter sub.

14. A method of setting an inflation packer apparatus in a well bore, comprising the steps of:

providing a tubing string including the packer apparatus, wherein the packer apparatus includes an inflatable packer bladder;

lowering the tubing string and packer apparatus into the well bore;

pumping an inflation fluid through the tubing string and into the packer apparatus;

inflating the inflatable packer bladder with the inflation fluid; and expanding the inflation fluid within the packer bladder.

15. The method of claim 14, wherein said step of expanding comprises dispersing a chemical expanding additive in the inflation fluid prior to said step of inflating.

16. The apparatus of claim 14, wherein said step of expanding comprises dispersing a chemical expanding additive in the inflation fluid, said expanding additive is selected from the group consisting of aluminum powder, deadburned magnesium oxide, and a blend containing gypsum.

17. The method of claim 14, wherein the packer apparatus comprises:

a packer body including the inflatable packer bladder; and a packer mandrel having a flow passage defined therethrough, wherein said step of inflating comprises:

directing the inflation fluid from the flow passage into an inflation fluid passageway defined between the packer body and packer mandrel until the inflatable bladder reaches a desired inflation pressure; and holding the inflation fluid under pressure in the inflation bladder.

18. The method of claim 17, wherein said step of expanding comprises:

placing a chemical expanding additive in the inflation fluid passageway prior to lowering the packer apparatus into the well bore; and dispersing the chemical expanding additive in the inflation fluid as the fluid is directed into the inflation fluid passageway.

19. The method of claim 18, wherein said step of placing comprises:

filling a plurality of grooves defined on an outer surface of the packer mandrel with the chemical expanding additive.

20. The method of claim 17, further comprising the steps of:

communicating the flow passage with the well bore after the inflatable bladder reaches the desired inflation pressure; and directing the inflation fluid from the flow passage into the well bore.

* * * * *